US009808392B2

(12) United States Patent
Haider et al.

(10) Patent No.: US 9,808,392 B2
(45) Date of Patent: Nov. 7, 2017

(54) MULTI-MODE HANDS-FREE CRUTCH

(71) Applicant: The Board of Regents of the University of Texas System, Austin, TX (US)

(72) Inventors: Waseem Haider, McAllen, TX (US); Mario Enrique Serrano, Jr., Edinburg, TX (US)

(73) Assignee: Board of Regents of the University of Texas System, Austin, TX (US)

( * ) Notice: Subject to any disclaimer, the term of this patent is extended or adjusted under 35 U.S.C. 154(b) by 235 days.

(21) Appl. No.: 14/671,328

(22) Filed: Mar. 27, 2015

(65) Prior Publication Data

US 2015/0272812 A1 Oct. 1, 2015

Related U.S. Application Data

(60) Provisional application No. 61/971,808, filed on Mar. 28, 2014.

(51) Int. Cl.
*A61H 3/00* (2006.01)
*A61H 3/02* (2006.01)

(52) U.S. Cl.
CPC ..... *A61H 3/02* (2013.01); *A61H 2003/005* (2013.01); *A61H 2003/007* (2013.01)

(58) Field of Classification Search
CPC ..... A61H 2003/005; A61H 2003/007; A61H 2003/0227; A61H 2003/0233; A61H 2003/0238
See application file for complete search history.

(56) References Cited

U.S. PATENT DOCUMENTS 2,707,962 A * 5/1955 Yandow ..... A61H 3/00 135/69
2,778,370 A * 1/1957 Chamblee ..... A61H 3/02 135/68
3,016,060 A * 1/1962 Beattie, Sr. ..... A61H 3/02 135/68
3,074,420 A * 1/1963 Gottman ..... A61H 3/02 135/69
3,205,905 A * 9/1965 Gottman ..... A61H 3/02 135/69

(Continued)

FOREIGN PATENT DOCUMENTS

FR 2680679 A1 * 3/1993 ..... A61H 3/02
FR 2979538 A1 * 3/2013 ..... A61H 3/02
WO WO 2008018114 A1 * 2/2008 ..... A61H 3/02

*Primary Examiner* — David R Dunn
*Assistant Examiner* — Danielle Jackson
(74) *Attorney, Agent, or Firm* — Meyertons, Hood, Kivlin, Kowert & Goetzel, P.C.

(57) ABSTRACT

A crutch includes a base, one or more leg support members coupled to the base, and an axillary support member coupled to the base. The leg support members are configurable to at least partially the weight of a person through the person's leg. The axillary support member is configurable to extend under one of the user's arms to at least partially bear weight of the person. The axillary support member may be adjustable to reversibly transform the crutch between axillary support of the person and leg support of the person. The crutch can be selectively configured for use in a hands-free walking mode, an axillary support mode, a sitting mode, or a compact mode.

13 Claims, 21 Drawing Sheets

(56) References Cited

U.S. PATENT DOCUMENTS 3,254,659 A * 6/1966 Williams ..... A61H 3/02 135/69
3,272,210 A * 9/1966 Boruvka ..... A61H 3/00 135/69
4,254,948 A * 3/1981 Jacobs ..... A61H 3/04 135/68
4,291,715 A * 9/1981 Monte ..... A61H 3/02 135/68
4,910,927 A * 3/1990 Beatty ..... A61H 3/02 135/66
5,318,058 A 6/1994 Zimmerman
5,746,236 A 5/1998 Tilsley
5,983,912 A * 11/1999 Leu ..... A61H 3/02 108/152
6,206,018 B1 * 3/2001 Daniels, Jr. ..... A61H 3/02 135/69
6,494,919 B1 * 12/2002 Matthews ..... A61F 2/601 135/67
6,932,096 B2 * 8/2005 Marek ..... A61H 3/02 135/68
7,303,537 B1 * 12/2007 Snyder ..... A61F 3/00 135/68
7,346,560 B1 * 3/2008 Tenorio ..... G06F 21/62 380/201
7,614,414 B2 * 11/2009 Jamshidi ..... A61H 3/02 135/66
8,146,615 B1 * 4/2012 Rodriguez ..... A61H 3/02 135/66
8,215,325 B2 * 7/2012 Montanti ..... A45B 1/00 135/65
9,072,649 B2 * 7/2015 LaFord ..... A61H 3/02
2004/0011392 A1 1/2004 Maulden et al.
2004/0112415 A1 6/2004 Shamieh et al.
2005/0109379 A1 * 5/2005 Rader ..... A61H 3/02 135/68
2005/0178416 A1 * 8/2005 Owens ..... A61H 3/02 135/69
2007/0012345 A1 * 1/2007 Owens ..... A61H 3/02 135/69
2009/0114692 A1 5/2009 Roman
2009/0229643 A1 * 9/2009 Ramm ..... A61H 3/02 135/69
2010/0269872 A1 10/2010 Tharp
2011/0041884 A1 * 2/2011 Hanna ..... A61H 3/02 135/66
2013/0152986 A1 * 6/2013 Hunter ..... A61H 3/02 135/66
2013/0184616 A1 * 7/2013 Sanders ..... A61H 3/02 601/33
2014/0096804 A1 * 4/2014 Keck ..... A61H 3/02 135/69
2015/0231019 A1 * 8/2015 Warder, Sr. ..... A61H 3/02 135/68

* cited by examiner

MULTI-MODE HANDS-FREE CRUTCH

PRIORITY CLAIM

This application claims priority to U.S. Provisional Application Ser. No. 61/971,808 entitled "MULTI-MODE HANDS-FREE CRUTCH" filed Mar. 28, 2014, which is incorporated herein by reference in its entirety.

BACKGROUND

Field

The present invention relates generally to crutches and mobility aids, and methods for using such items. More particularly, the present disclosure relates to crutches that can be used by persons with lower leg injuries.

Description of the Related Art

Persons who have suffered leg or foot injuries often use crutches as mobility aids while the injury heals. Traditional crutches allow the injured person to apply weight at the person's axillary region (under the armpit), thereby allowing the person to shift at least some of the weight that would be transferred through the person's legs to instead be carried by the crutches.

Some non-traditional crutches allow a person to apply rest a leg on a short staff or post. Straps may be used to secure the crutch to the person's leg so that the person can walk around with the crutch. Such non-traditional crutches may have the advantage of being "hands free". Such devices may, however, be bulky and may have limited adjustment capability that does not suit the person's particular needs. Also, for some injuries, a user may need to have a traditional crutch at one stage of recovery and a non-traditional at another stage of recovery. In such situations, the person may bear the added expense of purchasing two mobility systems instead of one for the injury.

SUMMARY

Embodiments of crutches and methods for using crutches are described herein. In an embodiment, a crutch includes a base, one or more leg support members coupled to the base, and an axillary support member coupled to the base. The leg support members are configurable to at least partially the weight of a person through the person's leg. The axillary support member is configurable to extend under one of the user's arms to at least partially bear weight of the person. The axillary support member may be adjustable to reversibly transform the crutch between axillary support of the person and leg support of the person. In some embodiments, a crutch can be selectively configured for use in a hands-free walking mode, an axillary support mode, a sitting mode, or a compact mode.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
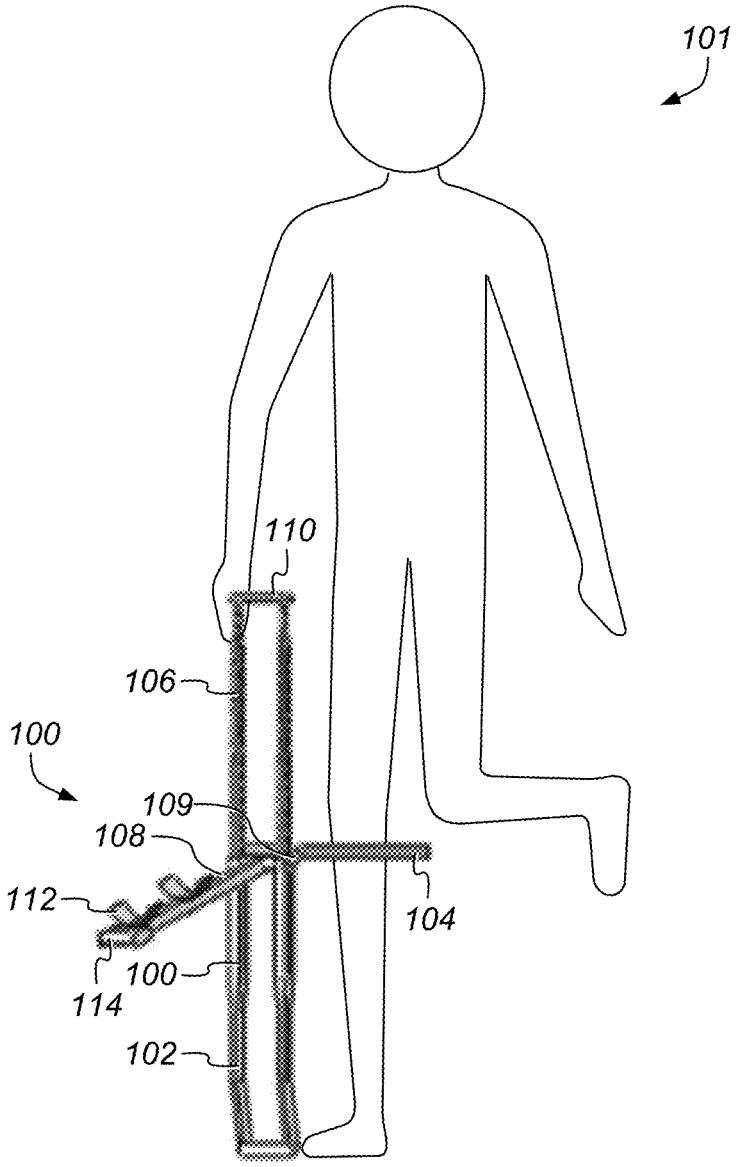
FIG. 1 illustrates one embodiment of an embodiment of a crutch that has members for multiple modes of use.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task. In some contexts, "configured to" may be a broad recitation of structure generally meaning "having a feature that" performs the task or tasks during operation. As such, the component can be configured to perform the task even when the component is not currently on.

Various components may be described as performing a task or tasks, for convenience in the description. Such descriptions should be interpreted as including the phrase "configured to." Reciting a component that is configured to perform one or more tasks is expressly intended not to invoke 35 U.S.C. §112 paragraph (f), interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

It is to be understood the present invention is not limited to particular devices or biological systems, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

DETAILED DESCRIPTION OF EMBODIMENTS

Definitions

Unless defined otherwise, all technical and scientific terms used herein have the same meaning as commonly understood by one of ordinary skill in the art.

The term "connected" as used herein generally refers to pieces which may be joined or linked together.

The term "coupled" as used herein generally refers to pieces which may be used operatively with each other, or joined or linked together, with or without one or more intervening members. As used herein, the term "coupling" or "coupled" includes a direct coupling or an indirect coupling. A "coupling" of two elements may be accomplished, for example, with a pivotal pin connection. A coupling may, however, also be accomplished with any various other elements and device. In some cases, a coupling is accomplished by way of a linkage. For example, two elements may be connected by intermediate links, such that the linked elements fold with respect to one another.

The term "crutch" as used herein generally refers to a device that supports or props up part of the body of a person. A crutch may support a limb, leg, part of the upper body, or combinations thereof. In some embodiments, a crutch includes a support in an axillary region of the user (e.g., a pad contacting an armpit of the user). A crutch may include one member or multiple members. Examples of a crutch member include a rod, a tube, staff, a frame, a bar, a stick, or a plate.

The term "directly" as used herein generally refers to one structure in physical contact with another structure, or, when used in reference to a procedure, means that one process effects another process or structure without the involvement of an intermediate step or component.

The term "lock mechanism" as used herein generally refers to any mechanism that holds an element in place relative to one or more other elements until any action is taken to release the lock mechanism.

The term "member" as used herein generally refers to a single element (for example, a rod), or a combination of two more elements. For example, a member may include two rods secured to one another, or a plate mounted on a bar. A member may be straight, curved, or an irregular shape.

The term "telescope" as used herein generally refers to the relationship of at least two elements with respect to one another in that one of the elements can be translated with respect to the other element to extend the combined length of the elements along a longitudinal axis of at least one of the elements. In some cases, a member of a telescoping assembly has an element with two or more elements that translate together (for example, tandem front and rear tubes in the upper portion of a crutch).

In some embodiments, a multi-mode hands-free crutch is used to help people that suffer lower leg injuries to continue with some of their normal activities. A multi-mode hands-free crutch may, in various embodiments, allow a user to choose between multiple modes (for example, different configurations of the positions of various members of a crutch) depending on what the user needs. In one embodiment, a crutch has four different modes. A 4-mode crutch system may include: Walking Mode I; Walking Mode II; Sitting Mode; and Compact Mode. The Compact mode may be used when the crutch is not needed. The Compact mode may allow the crutch to be stored in relatively small amount of space.

In some embodiments, a multi-mode hands-free crutch allows a user having an injured leg to move about without needing to secure the crutch to their arm or shoulder. A hands-free crutch may be capable of adopting various different configurations, based on the needs of the user. The multi-mode hands-free crutch may be configured to couple to the leg of a user such that the crutch serves as a temporary lower leg of the user, allowing the user to walk while keeping weight off of the injured portion of the leg. The configuration of the crutch may be altered to allow the crutch to be used as a traditional crutch, with the user holding the crutch and using the crutch to keep weight off the injured portion of the leg. In a third configuration, the crutch may be configured to support the injured leg while the user is sitting. In some embodiments, a multi-mode hands-free crutch is capable of being transformed into each of the three configurations, without adding any additional parts and without removing any parts. The multi-mode hands-free crutch may also be collapsible for transportation and storage.

In some embodiments, a multi-mode hands-free crutch replaces a traditional crutch that is used by people who have suffered a short-term injury on the foot or ankle. A crutch as described herein may give a user an opportunity to perform daily activities that they are difficult or unable to do with traditional crutches.

In some embodiments, a leg support crutch is transformable into a crutch including axillary support. The device may allow a user to gradually increase the weight on the injured foot until the user is able to walk on his or her own (for example, without crutches) without pain or difficulty.

In some embodiments, a crutch serves as a prosthetic leg, portion of a leg, or foot. For example, a crutch may serve as prosthesis for the portion of a person's leg from the knee down.

FIG. 1 illustrates one embodiment of a crutch that has members for multiple modes of use. Crutch 100 may be used by person 101. Crutch 100 includes base 102, platform member 104, upper support 106, and upper leg support member 108. Platform member 104 is coupled to base 102 by way of linkage 109. Platform member 104 may be pivotally coupled and foldable relative to base 102. Upper leg support member 108 may be pivotally coupled and foldable relative to base 102. Upper support includes axillary pad 110.

Upper leg support member 108 includes upper leg coupling elements 112 and hand grip 114. Upper leg coupling elements 112 may include one or more straps for coupling upper leg support member 108 to the upper leg of person 101. In one embodiment, a crutch includes two straps, spaced from top to bottom of upper leg support member 108. A crutch may, however, include any number of straps or other elements for securing a part of a leg to a crutch support member. Each strap may go around the person's leg. Each strap may have a way of securing the strap to the leg, for example, by complementary hook-and-loop strips, a buckle, or cinching members. The embodiment depicted in FIG. 12 includes upper leg coupling elements 112. FIGS. 13A-B illustrate a perspective view of an embodiment of an upper leg coupling element 112 in an engaged state (e.g., as depicted in FIG. 13A) and in an unengaged state (e.g., as depicted in FIG. 13B).

In some embodiments, coupling elements 112 are composed of at least two parts (e.g., as depicted in FIGS. 13A-B). In some embodiments, portion 112*a* is substantially inflexible and may be adjusted to the proper measure (e.g., length, diameter) of the leg of the user. This may facilitate stability and reduce the movement of the crutch without causing the user to lose balance. In some embodiments, portion 112*b* of the coupling element includes a flexible member. Portion 112*b* may allow the user to tighten the coupling element so it will be inhibited from movement (e.g., such that the user is comfortable).

In various embodiments, platform member 104 and upper leg support member 108 may serve each serve as leg support members. In some embodiments, the weight of body may be applied partially to upper leg support member 108 and partially to platform member 104. All of the weight transferred to platform member 104 and upper leg support member 108 may be borne by base 102.

In some embodiments, a crutch includes one or more lock mechanisms. Each lock mechanism may secure different members in a desired position or orientation with respect to other members. For example, a lock mechanism may be provided to lock the angle of platform member 104 relative to base 102. Additional lock mechanisms may be provided to lock upper support 106 relative to base 102, and to lock upper leg support member 108 relative to base 102. In some embodiments, a sliding member is locked by way of spring-loaded retractable pins. Any suitable mechanism for locking the position of a member may be used, however. Examples of other lock mechanisms include a thumb screw, cam-lock, hook and loop, a clip, or a clamp.

Various embodiments of a crutch are described below, in the context of illustrative modes of use.

Walking Mode I

Figure 2:
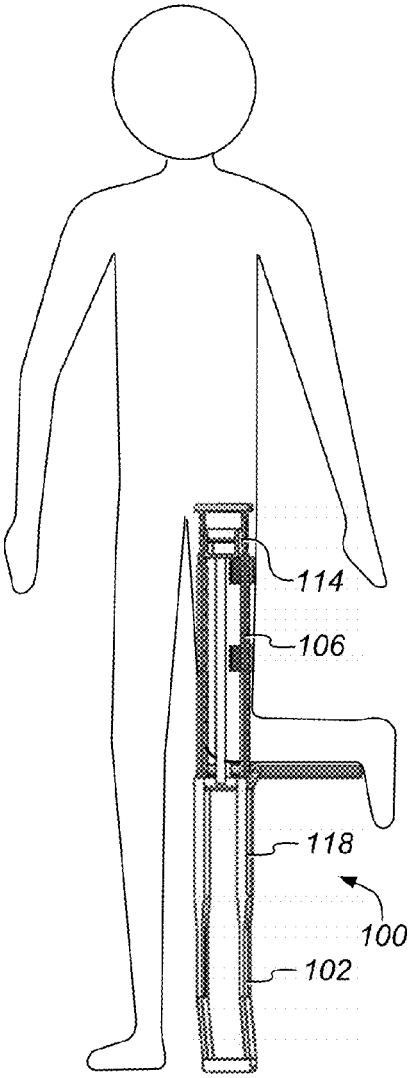
FIG. 2 illustrates one walking mode of an embodiment of a crutch system.

FIG. 2 illustrates one walking mode of a crutch system (referred to herein as "Walking Mode I"). Walking Mode I gives the injured user the ability to walk and perform some of the normal activities that he/she wouldn't be able to do with a lower leg injury. The user may take the position in FIG. 2 and secure the injured leg to the upper leg support member with bands. The weight of the user is distributed over the platform, giving the user the balance and support needed to walk.

Figure 3:
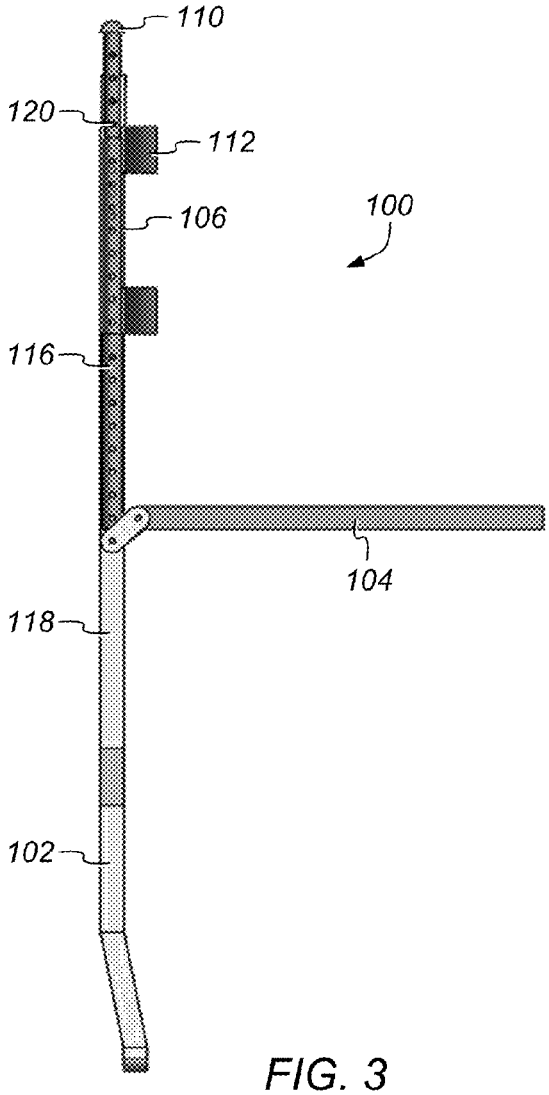
FIG. 3 illustrates a side view of an embodiment of a crutch set up for a hands-free walking mode.

FIG. 3 illustrates a side view of a crutch set up for a hands-free walking mode. Upper support 106 includes telescoping sections 116. Telescoping sections 116 may be progressively extended from tubes 118 of base 102 to raise the height of upper support 106. The height of upper support 106 may be fixed by way of a pin 120 engaging in an appropriate hole in each of sections 116. In some embodiments, the dimensions of the crutch may vary depending on the needs of the user.

Platform member 104 may be raised to a horizontal position and locked into position. Upper support leg support member 108 may be swung into a vertical position, between the opposing struts of upper support 106.

Figure 4A:
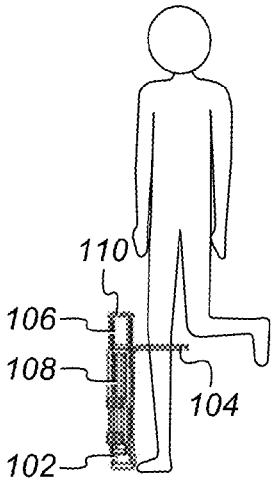
FIGS. 4A-4C illustrate preparing for use of an embodiment of a crutch in a hands-free walking mode.
Figure 4B:
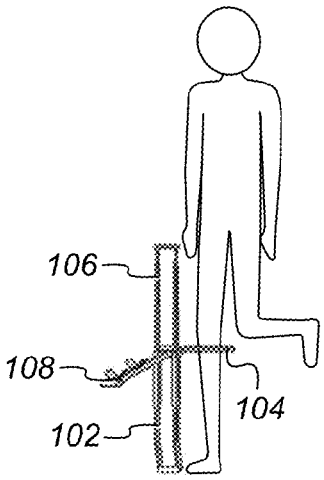
Figure 4C:
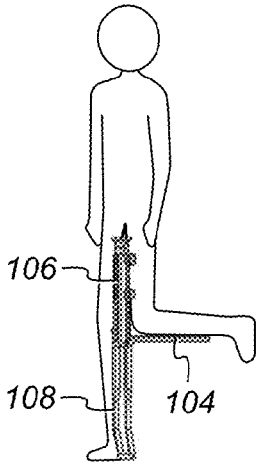

FIGS. 4A-4C illustrate preparing for use of the crutch in a hands-free walking mode.

Figure 12:
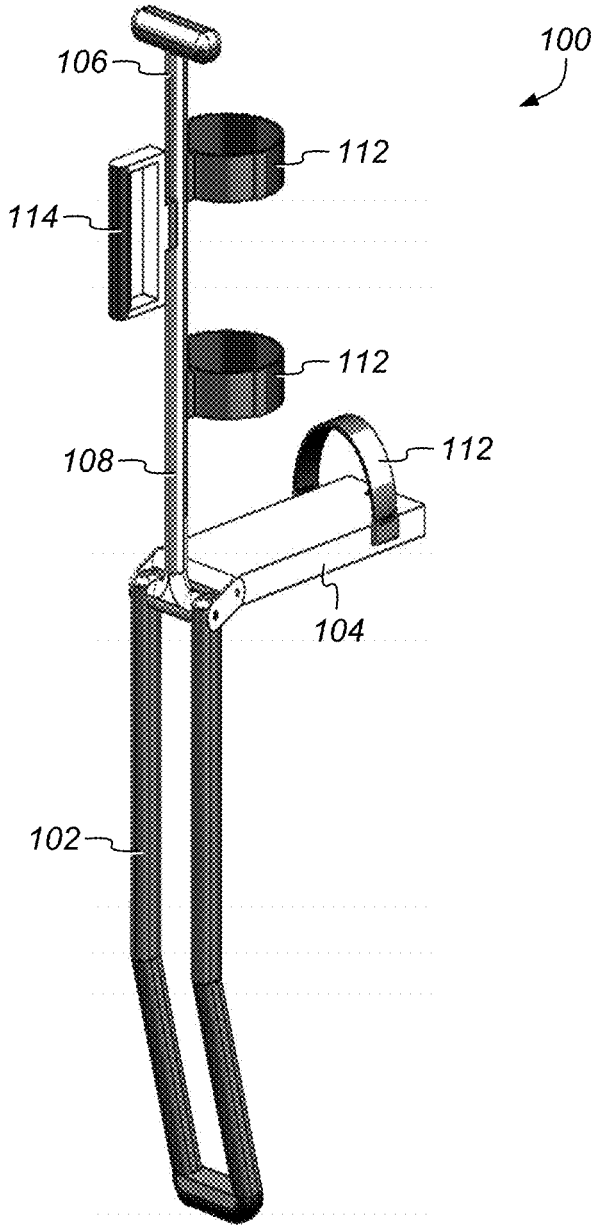
FIG. 12 illustrates a perspective view of an embodiment of a crutch set up for a hands-free walking mode.
Figure 13A:
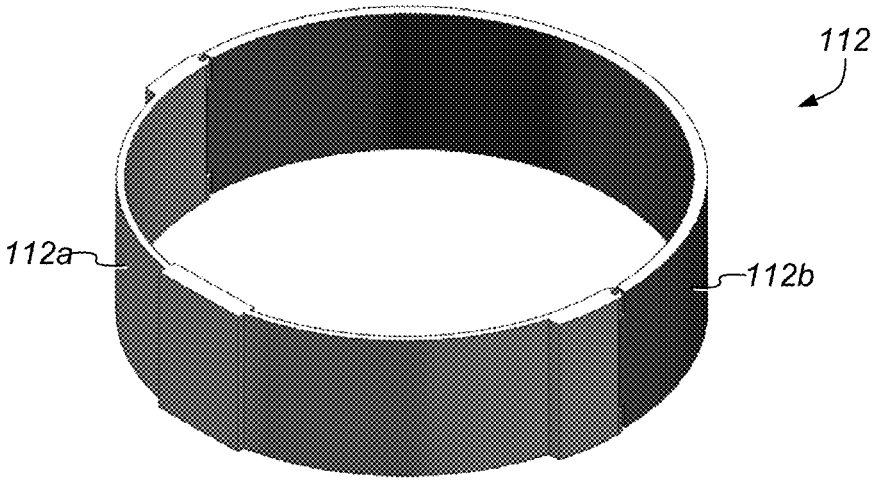
FIGS. 13A-B illustrate a perspective view of an embodiment of an upper leg coupling elements.
Figure 13B:
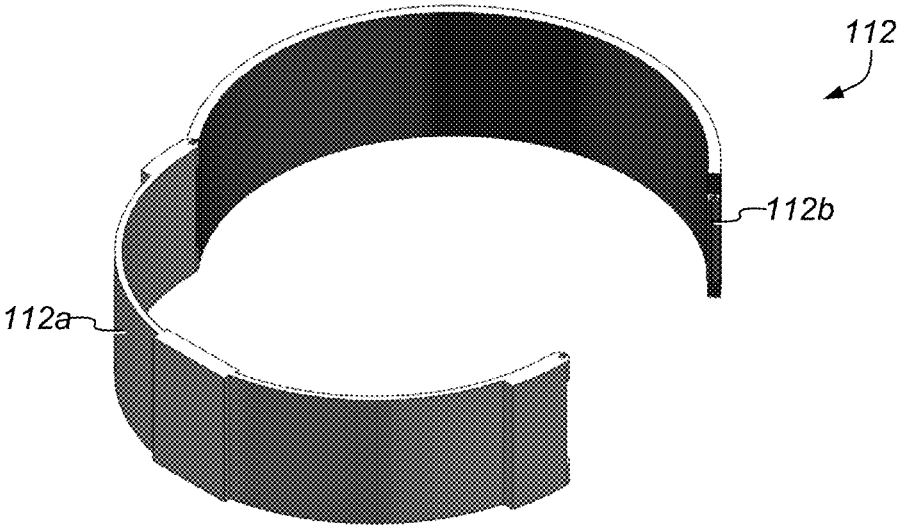
Figure 14:
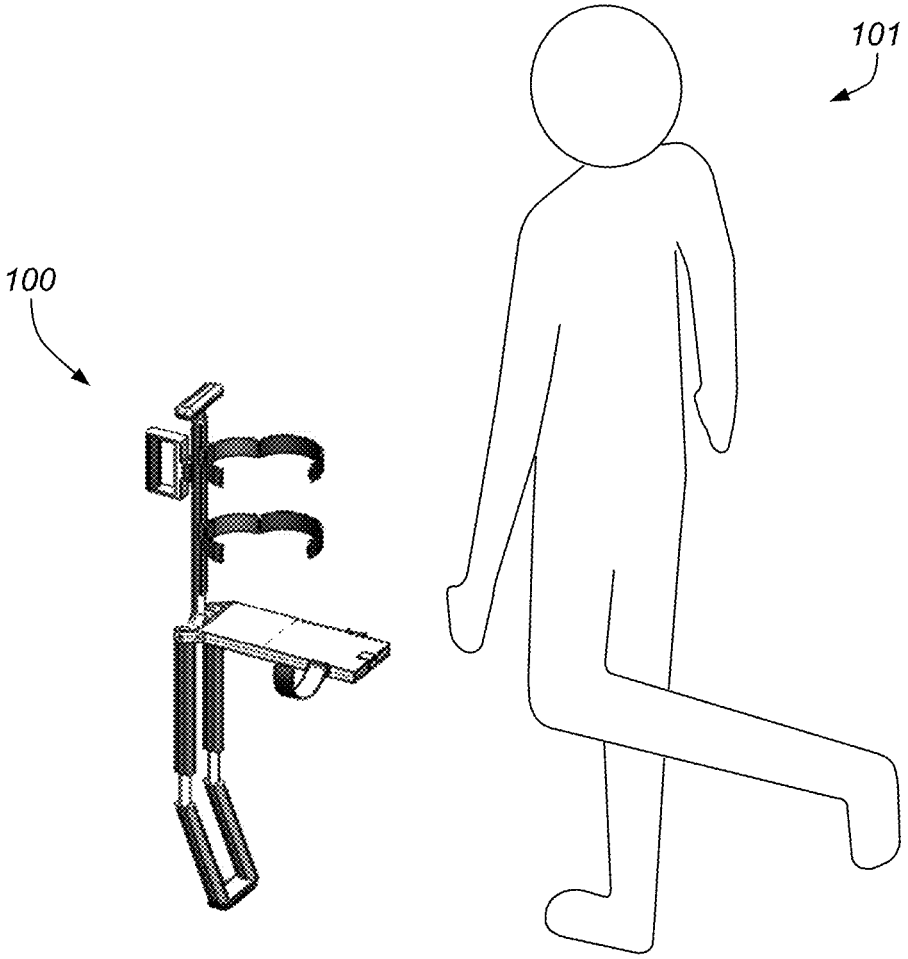
FIG. 14 illustrates one embodiment of a crutch that has members for multiple modes of use before attachment to a user.
Figure 15:
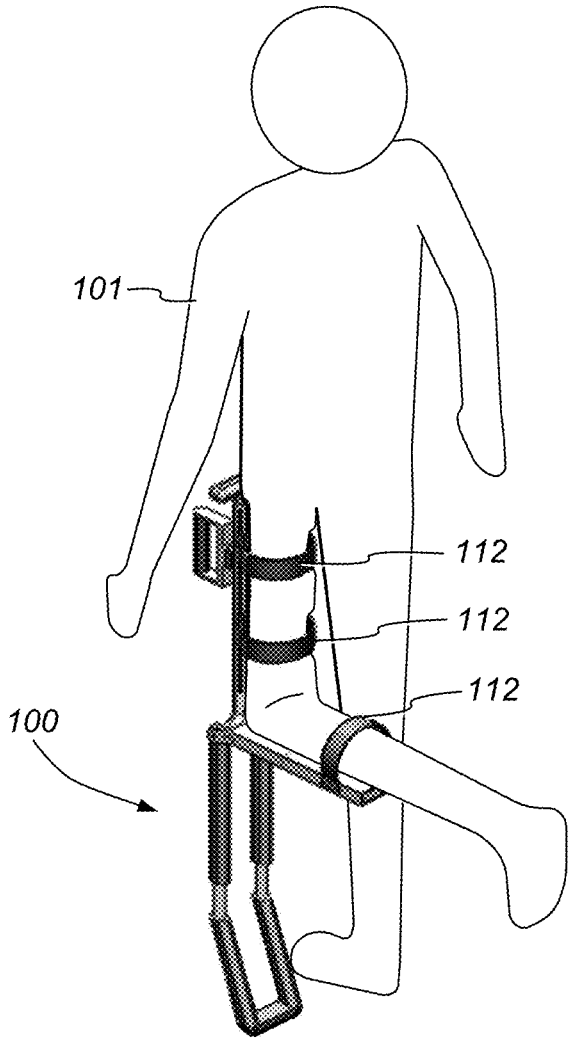
FIG. 15 illustrates one embodiment of a crutch that has members for multiple modes of use after attachment to a user.

FIG. 12 illustrates a perspective view of an embodiment of a crutch set up for a hands-free walking mode. The embodiment depicted in FIG. 12 depicts a more efficient design. At least one difference is that upper support 106 is now combined with an upper support leg support member 108 such that there are fewer parts for a user to deal with when converting from different modes of the crutch 100. FIG. 14 illustrates one embodiment of a crutch 100 that has members for multiple modes of use before attachment to a user 101. FIG. 14 depicts crutch 100 in walking mode I uncoupled from the user 101. FIG. 15 depicts crutch 100 in walking mode I coupled to the user 101 using, for example, at least coupling elements 112.

In order to be able to use Walking Mode I, the crutch 100 needs to placed on the injured leg as shown in FIG. 15. The crutch may be kept in position by 3 coupling elements 112, 2 on the upper leg support and 1 at the lower leg support.

Figure 25:
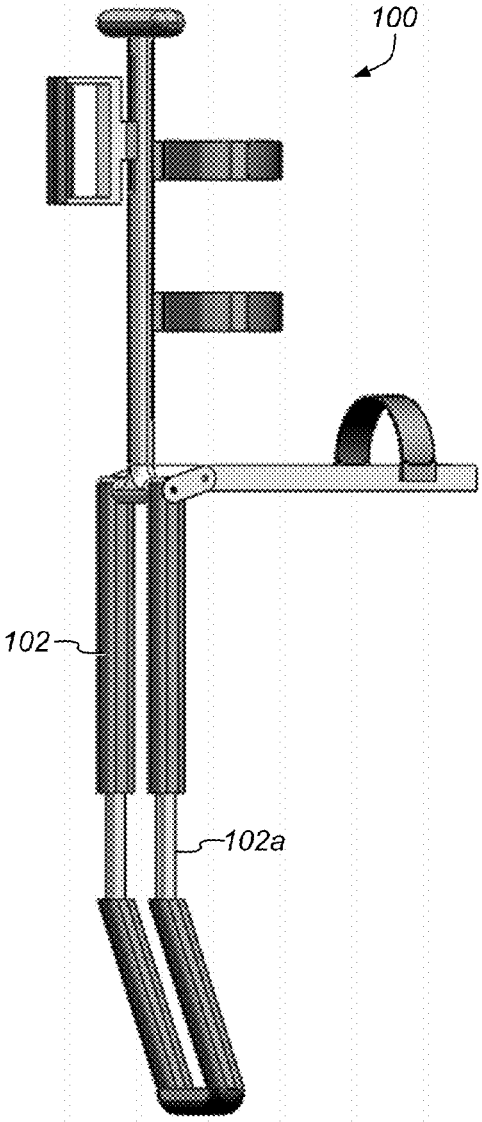
FIG. 25 illustrate one embodiment of a crutch that has members for multiple modes of use with a base including a base extension extending out of the base.

In some embodiments, base 102 may include a base extension 102*a*. Base extension 102*a* may provide the users the opportunity to adjust the length of base 102 to an equivalent length of the user's injured limb. Adjusting a length of the base such that the base is an equivalent length of the user's injured limb may allow the user to walk in a comfortable and safe manner when being used in one or more modes, for example, Walking Mode I (e.g, base extension 102*a* is extended as depicted in FIG. 25). A portion of base extension 102*a* may extend out of an interior of a portion (e.g., a hollow tube) of base 102 (in other embodiments a portion of the base 102 may extend out of an interior of a portion of base extension 102*a*).

In some embodiments, base extension 102*a* may be inhibited from moving relative to base 102 by way of spring-loaded retractable pins. Any suitable mechanism for locking the position of a member may be used, however. Examples of other lock mechanisms include a thumb screw, cam-lock, hook and loop, a clip, or a clamp.

Walking Mode II

Figure 5:
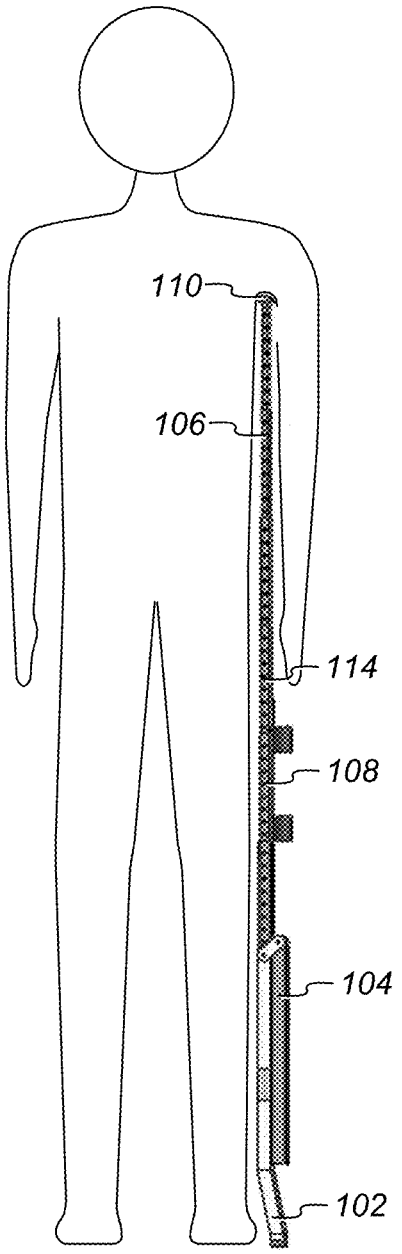
FIG. 5 illustrates a front view of an embodiment of a second walking mode of a crutch system in which axillary support is used.
Figure 6:
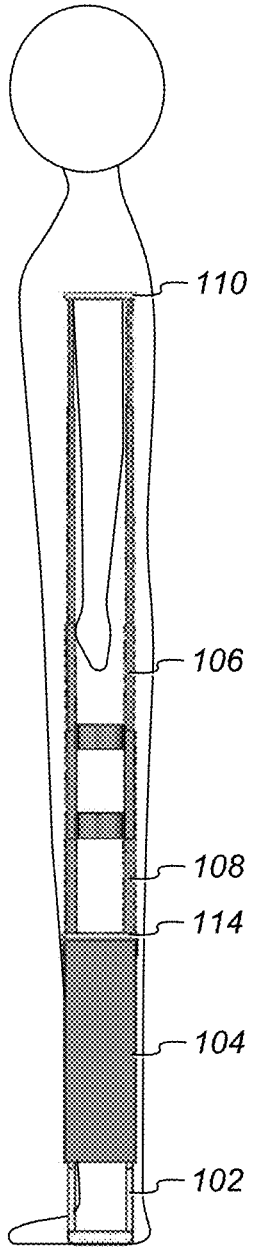
FIG. 6 illustrates a side view of an embodiment of a second walking mode of a crutch system in which axillary support is used.

FIG. 5 illustrates a front view of a second walking mode of a crutch system in which axillary support is used (referred to herein as "Walking Mode II"). FIG. 6 illustrates a side view of a second walking mode of a crutch system in which axillary support is used. After the cast, ankle boot or bandaging had been removed the user may be able to start the rehabilitation time. The foot has been disabled for a short time period so full weight bearing is gradually increased as tolerated by the patient. It typically takes seven to 10 days after the procedure, until the patient is comfortable without the assistance of a crutch.

In some embodiments, a crutch configured for supporting a lower limb is transformed into a traditional crutch, which is meant to be an aid for the rehabilitation of the lower leg injury. Walking Mode II will help the user until the limb is able to support the user weight. Walking Mode II will provide the user the same function of a regular crutch during the period of rehabilitation. This may eliminate the need to buy a second device to start the rehabilitation.

In some embodiments, upper support 106 may telescope to extend axillary support pad 110 to an armpit of a user. In some embodiments, when at the appropriate height, upper support 106 may be locked in place. Upper leg support member 108 may be swung upwardly into a vertical position such that hand grip 114 is in a suitable location for using crutch 100. In some embodiments, when at the appropriate height, upper leg support member 108 may be swung upwardly into a vertical position such that hand grip 114 is in a suitable location for using crutch 100.

Figure 7A:
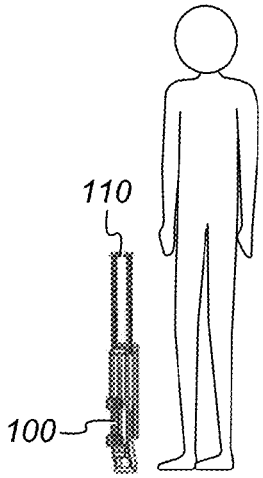
FIGS. 7A-7C illustrate preparing for use of an embodiment of the crutch in a walking mode with axillary support.
Figure 7B:
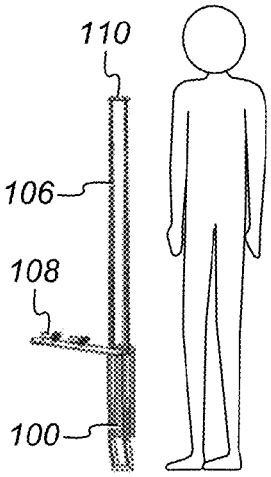
Figure 7C:
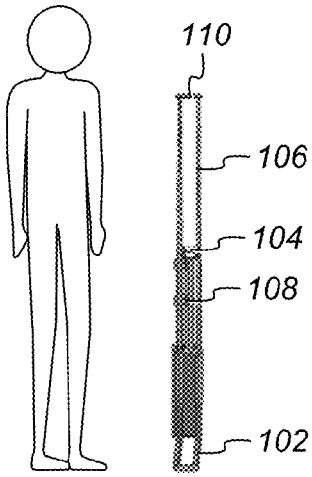

FIGS. 7A-7C illustrate preparing for use of the crutch in a walking mode with axillary support.

Figure 16:
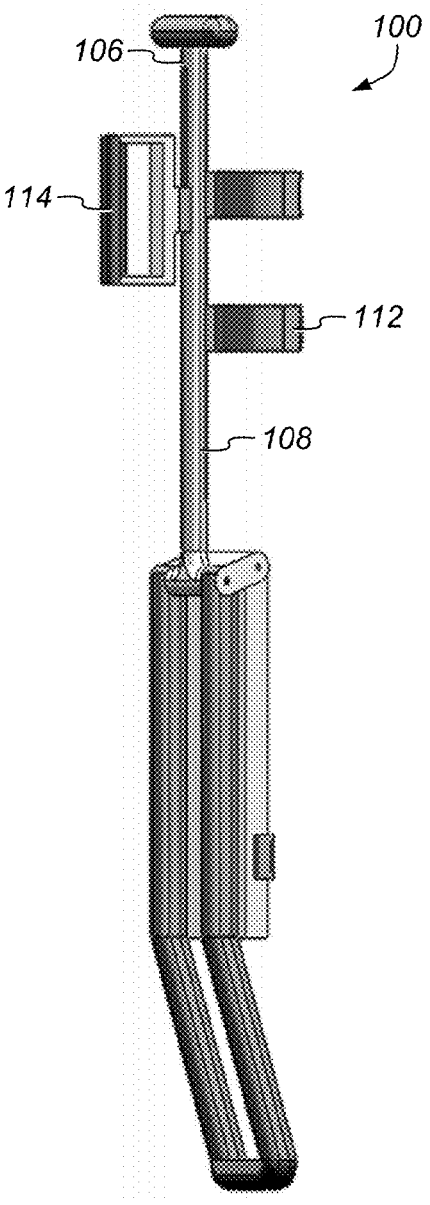
FIG. 16 illustrates one embodiment of a crutch that has members for multiple modes of use with a hand grip in a locked position.

FIG. 16 illustrates one embodiment of a crutch 100 that has members for multiple modes of use. The hand grip 114 is depicted in a locked position in FIG. 16. The embodiment depicted in FIG. 16 depicts a more efficient design. In the embodiment depicted in FIG. 16 upper support 106 is combined with an upper support leg support member 108 such that the upper support 106 is positionable inside the upper support leg support member 108 and there are fewer parts for a user to have to manipulate when converting from different modes of the crutch 100.

Figure 17:
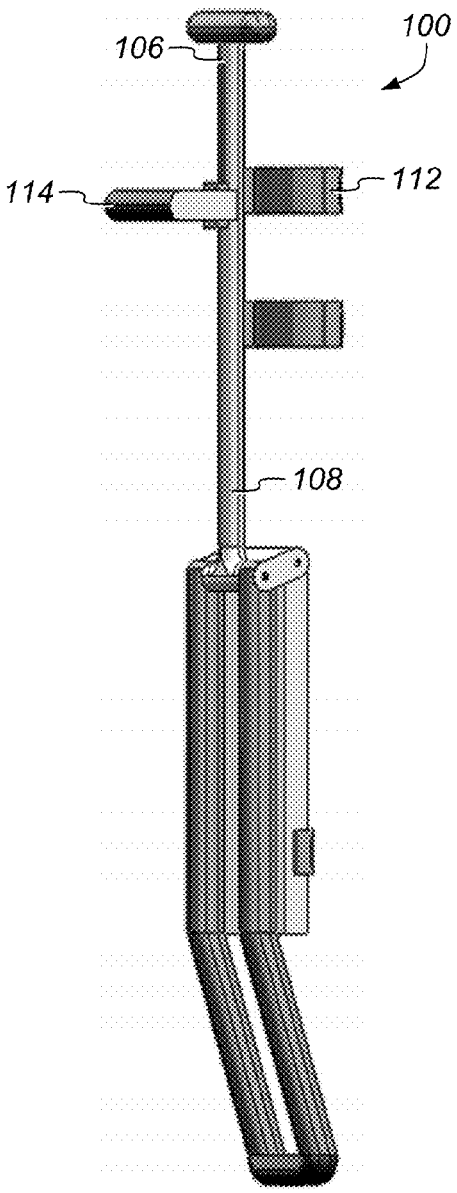
FIG. 17 illustrates one embodiment of a crutch that has members for multiple modes of use with a hand grip in an unlocked position.
Figure 18:
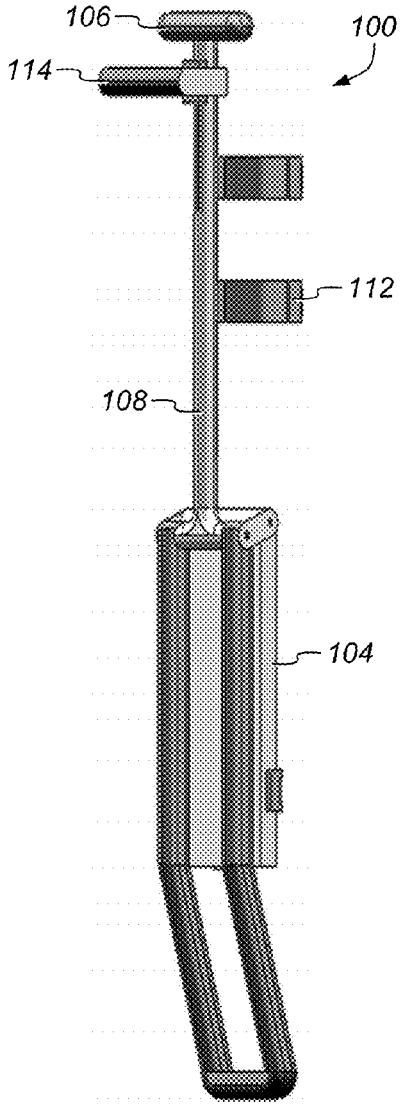
FIG. 18 illustrates one embodiment of a crutch that has members for multiple modes of use with a hand grip in an unlocked position with a height of the handle adjusted relative to the crutch.

The first position depicted in FIG. 16, hand grip 114 is locked and is typically not being used by the user. When the user needs to use the device as a crutch (Walking Mode II) the hand grip 114 may be first unlocked (e.g., rotated 90 degrees as depicted in FIG. 17). Once unlocked, the hand grip 114 may be repositioned along upper support leg support member 108 as depicted in FIG. 18. Once repositioned the hand grip 114 may be locked into position. Depending on the length of the user (e.g., user's arm and/or user's leg) the hand grip 114 may be adjusted to different heights (e.g., as depicted in FIG. 18).

In some embodiments, hand grip 114 may be inhibited from moving relative to upper support leg support member 108 by way of spring-loaded retractable pins. Any suitable mechanism for locking the position of a member may be used, however. Examples of other lock mechanisms include a thumb screw, cam-lock, hook and loop, a clip, or a clamp.

Figure 26:
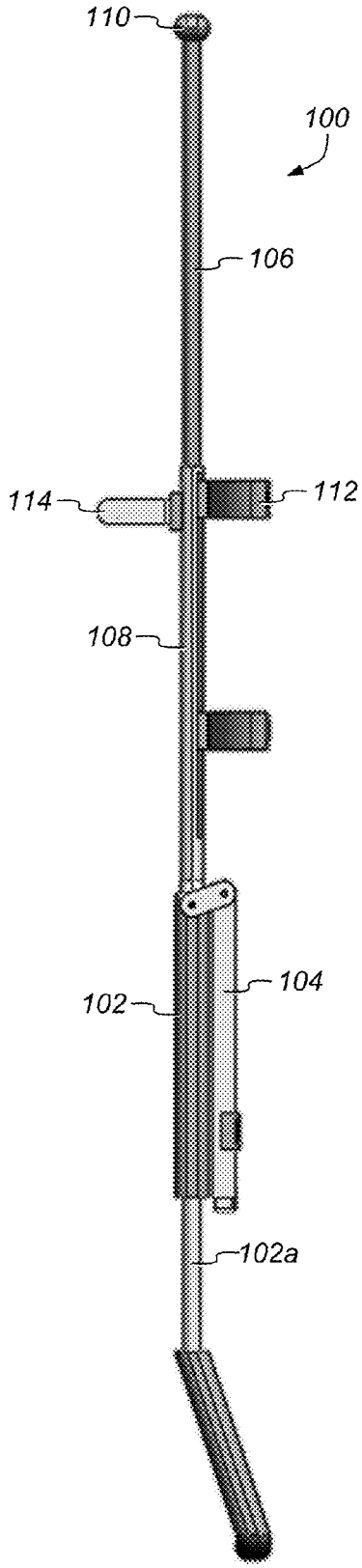
FIG. 26 illustrate one embodiment of a crutch that has members for multiple modes of use with a base including a base extension extending out of the base and an adjustable upper support extended out in walking mode II.

In some embodiments, base 102 may include a base extension 102*a*. Base extension 102*a* may provide the users the opportunity to adjust the length of base 102 to an equivalent length of the user's injured limb. Adjusting a length of the base such that the base is an equivalent length of the user's injured limb may allow the user to walk in a comfortable and safe manner when being used in one or more modes, for example, Walking Mode II (e.g., base extension 102*a* is extended as depicted in FIG. 26).

In some embodiments, base extension 102*a* may be inhibited from moving relative to base 102 by way of spring-loaded retractable pins. Any suitable mechanism for locking the position of a member may be used, however. Examples of other lock mechanisms include a thumb screw, cam-lock, hook and loop, a clip, or a clamp.

In some embodiments, upper support 106 may telescope to extend axillary support pad 110 to an armpit of a user. When at the appropriate height, upper support 106 may be locked in place. Upper support 106 may extend out of upper leg support member 108 and locked into position relative to support member 108 (e.g., as depicted in FIG. 26 in Walking Mode II). In FIG. 26 support 106 is extended out of support member 108 as well as base extension 102*a* is extending out of an interior of a portion (e.g., a hollow tube) of base 102.

Sitting Mode

Figure 8:
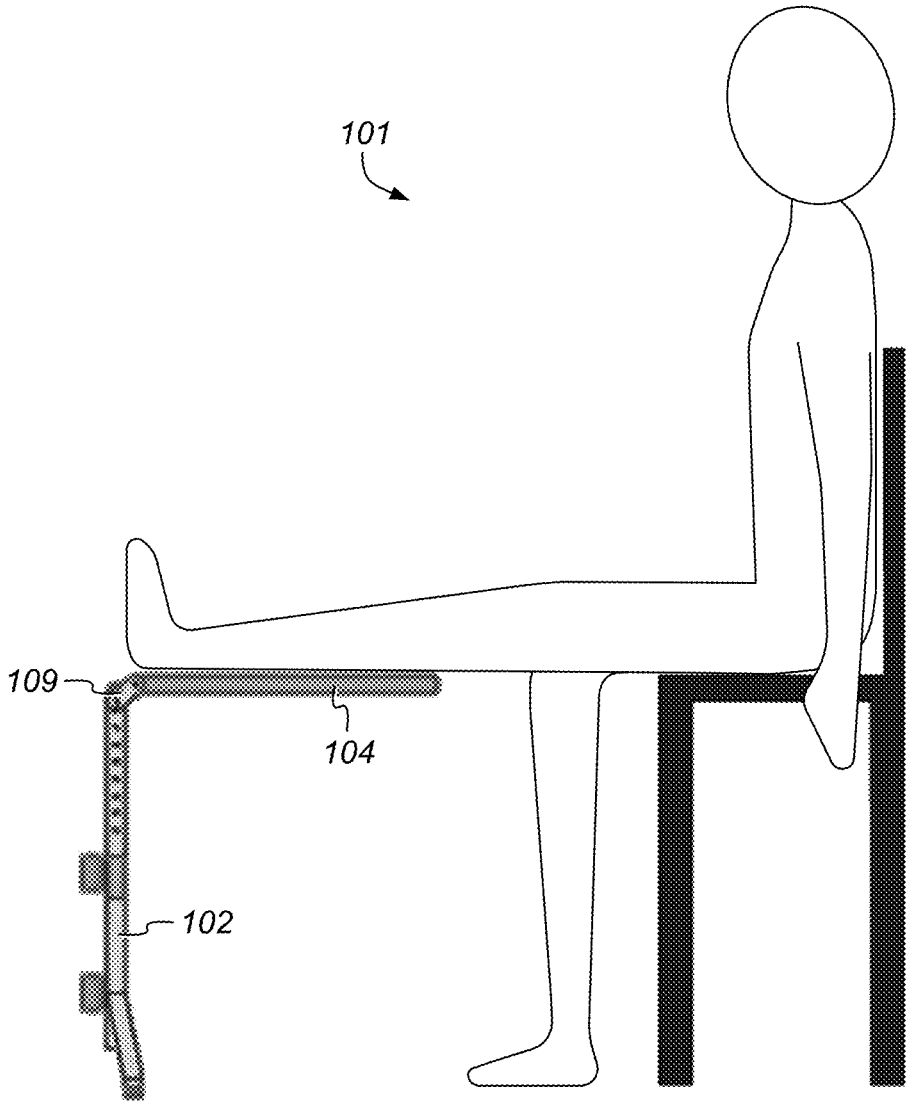
FIG. 8 illustrates a user in a sitting mode of an embodiment of a crutch system.

FIG. 8 illustrates a user in a sitting mode of a crutch system. For some injuries, it is recommended that at person keep a casted or splinted limb elevated (for example, propped up) when the person is able to do so. This may reduce the swelling and help to keep the cast from becoming too tight. In the sitting mode, a crutch may be used to allow the user to be on this recommended position.

Sometimes there are no objects around with the proper height to help the user to relive the pressure from the injured foot. The sitting mode for the crutch may provide the user the opportunity to adjust the height and angle to where the user feels comfortable while sitting or resting.

Figure 9:
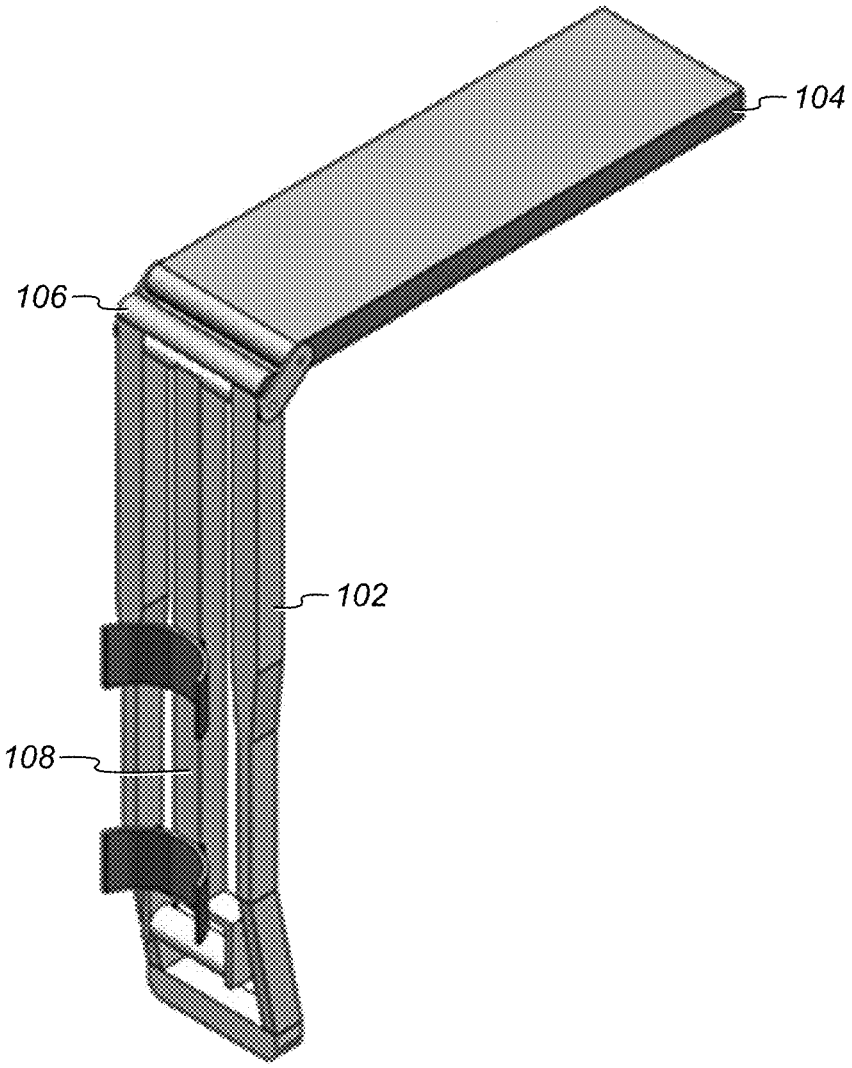
FIG. 9 illustrates an embodiment of a crutch with a platform member extended rearwardly to support the weight of part of a leg in a sitting mode.

FIG. 9 illustrates a crutch with a platform member extended rearwardly to support the weight of part of a leg in a sitting mode. Platform member 104 may be folded upward from base 102.

In the Sitting Mode, upper support 106 may be retracted into base 102, and upper leg support member 108 may be folded down to the position shown in FIG. 9.

In some embodiments, platform member 104 may include platform extension 104*a*. Platform extension 104*a* may provide extended surfaces to support an injured leg (e.g., in positions Walking Mode I and Sitting Mode). In some embodiments, platform extension 104*a* may be positionable inside platform member 104. When required (e.g., when being used by a person with a long leg) the user will be able to extract at least a portion of the platform extension as needed. The platform extension may include lock 105. The lock 105 may function to inhibit movement of the extension relative to the platform member.

Figure 19:
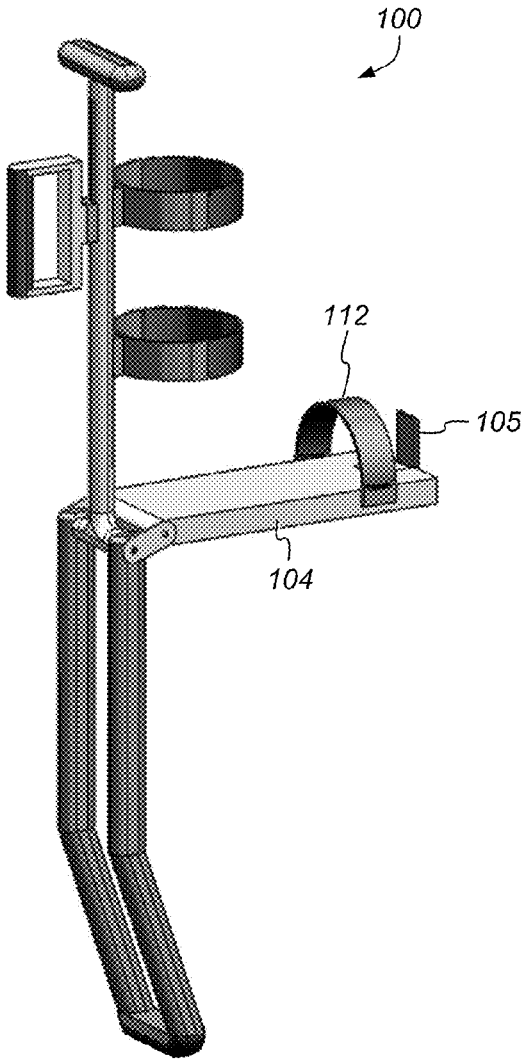
FIG. 19 illustrates one embodiment of a crutch that has members for multiple modes of use with a platform member including an extension in an unlocked position.
Figure 20:
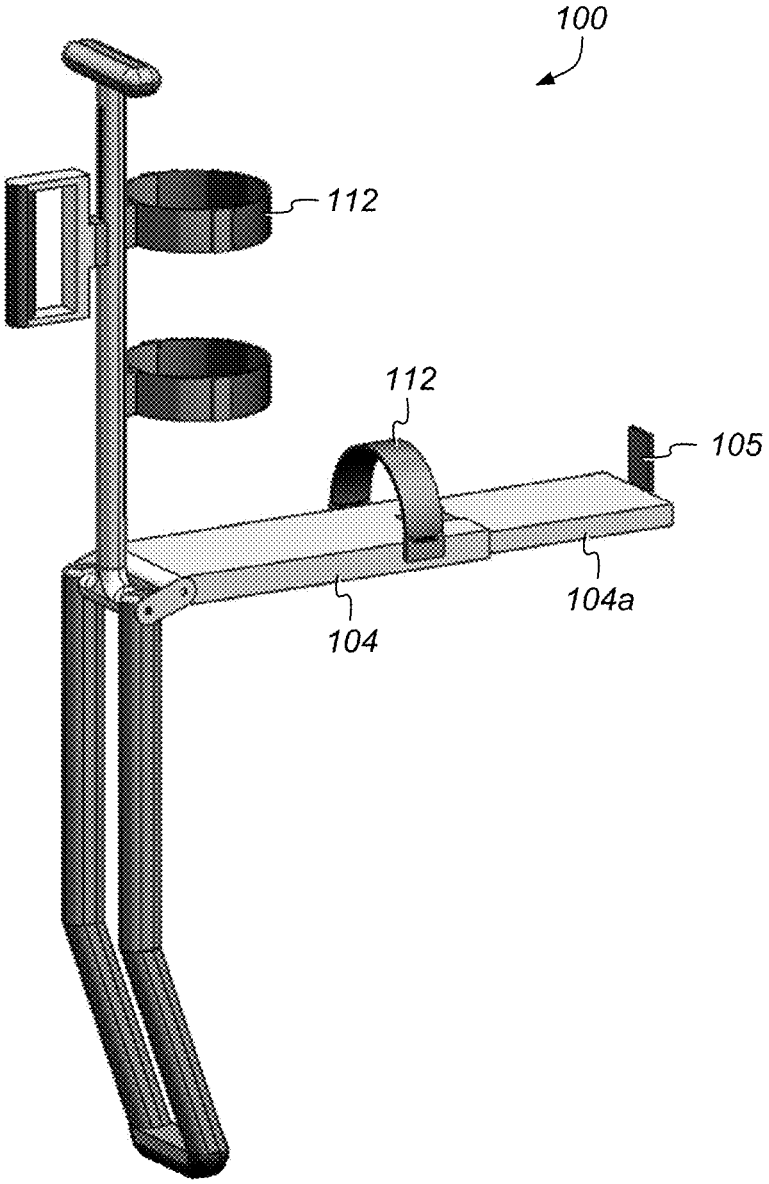
FIG. 20 illustrates one embodiment of a crutch that has members for multiple modes of use with a platform member including an extension in an unlocked position and extending out of the platform member.

In Walking Mode I when the lock is disengaged (e.g., as depicted in FIG. 19 wherein the crutch is depicted in Walking Mode I) the platform extension may be positionable relative to the platform member (e.g., platform extension is extendable as depicted in FIG. 20 wherein the crutch is depicted in Walking Mode I). In some embodiments, when the lock is engaged the platform extension may be inhibited from moving relative to the platform member in any relative position. In some embodiments, the unengaged lock may function as a supporting member for a user.

Figure 21A:
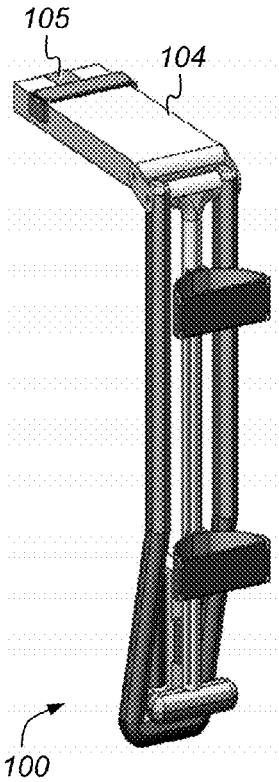
FIGS. 21A-C illustrates one embodiment of a crutch that has members for multiple modes of use with a platform member in a sitting mode including an extension in a locked position, an unlocked position, and extending out of the platform member.
Figure 21B:
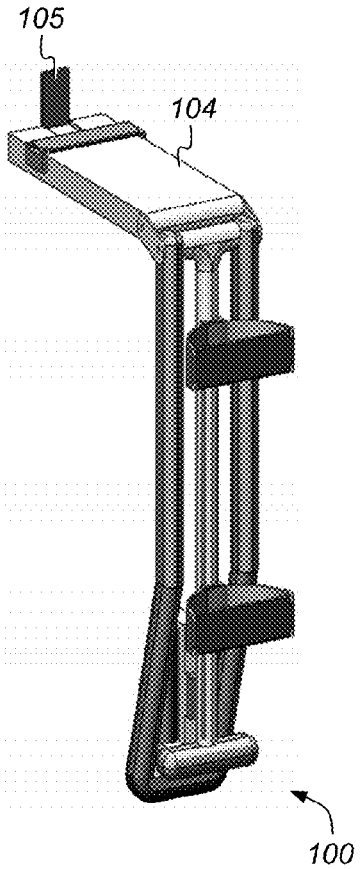
Figure 21C:
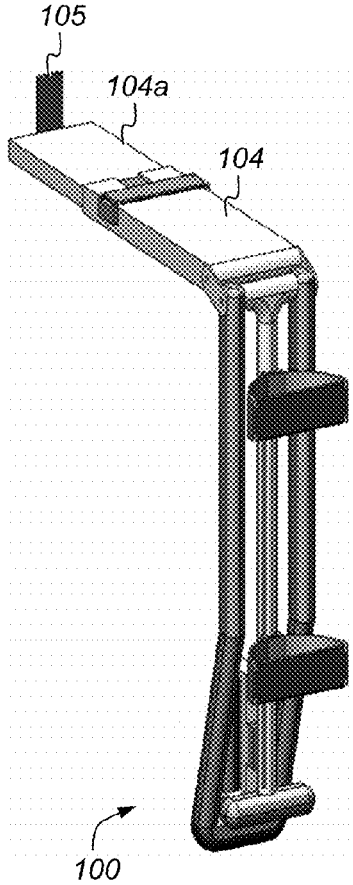

In some embodiments, the Sitting Mode may allow a user to rest their injured limb in a proper position and with comfort (e.g., as depicted in FIGS. 21A-C). Depending on the space available and the preference of each user, they will be able to set the leg support in many positions by first disengaging lock 105 (e.g., as depicted in FIG. 21B) and extending platform extension 104*a* (e.g., as depicted in FIG. 21C).

Figure 22:
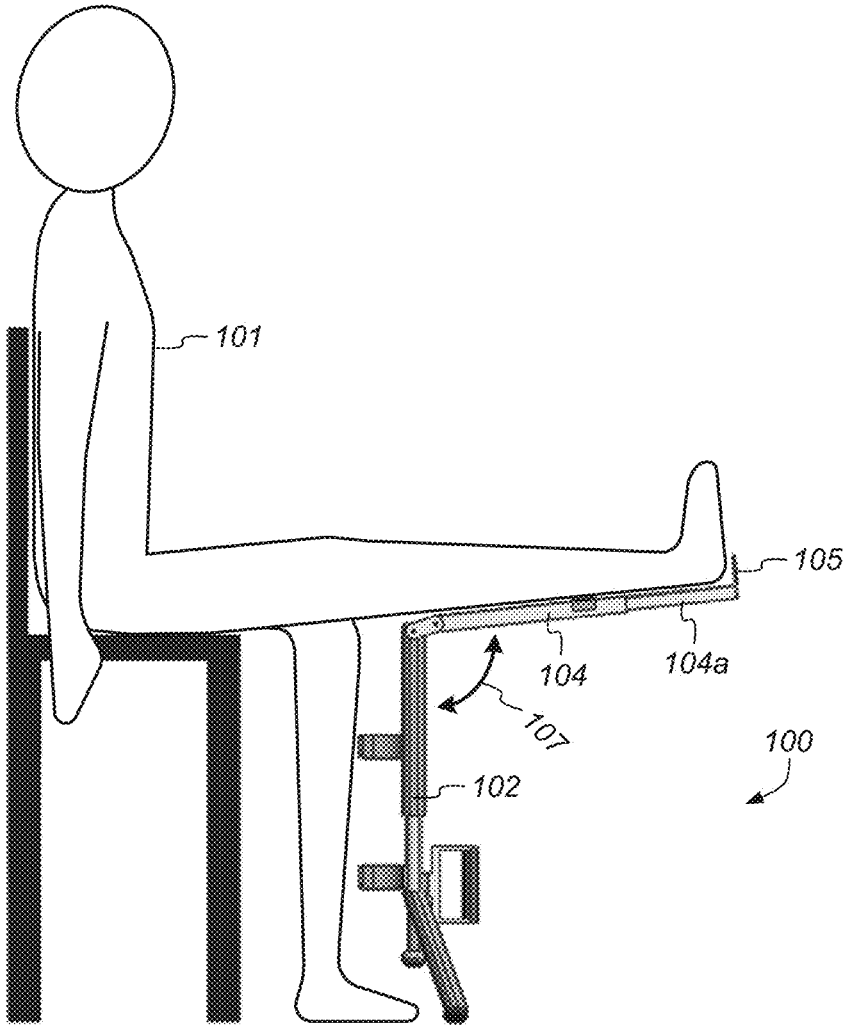
FIG. 22 illustrate one embodiment of a crutch that has members for multiple modes of use with a platform member in a sitting mode including an extension extending out of the platform member in use by a user at a first angle.
Figure 23:
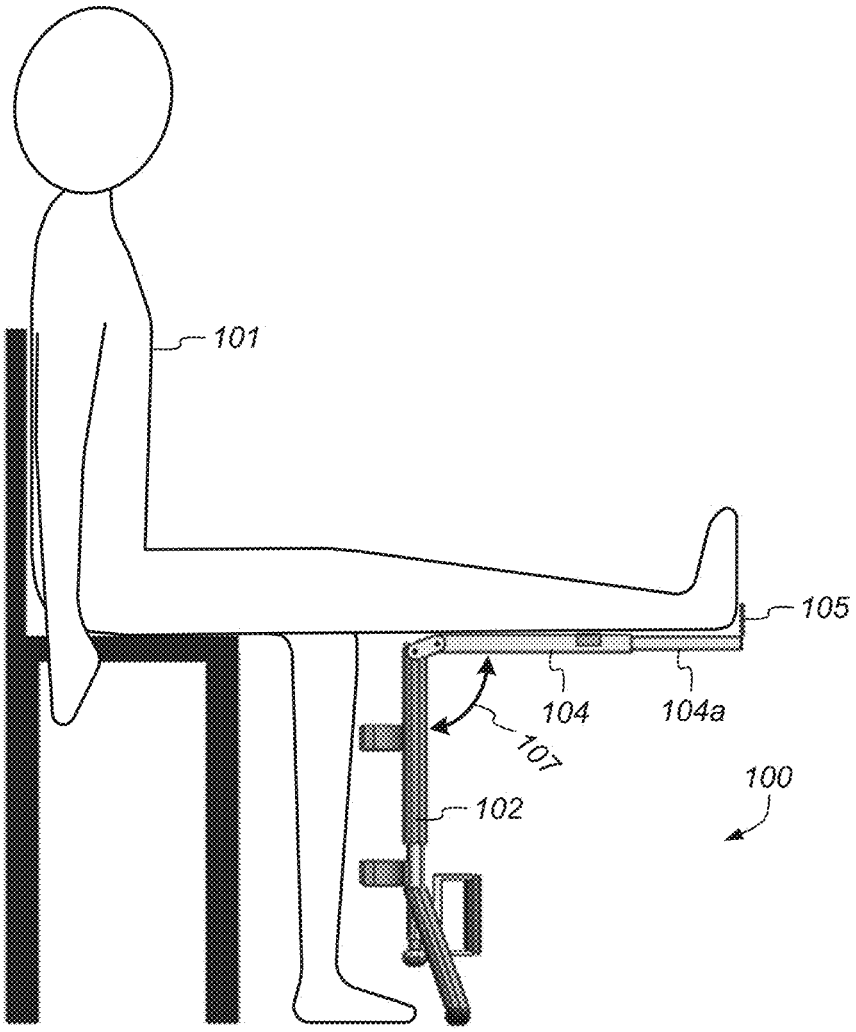
FIG. 23 illustrate one embodiment of a crutch that has members for multiple modes of use with a platform member in a sitting mode including an extension extending out of the platform member in use by a user at a second angle.
Figure 24:
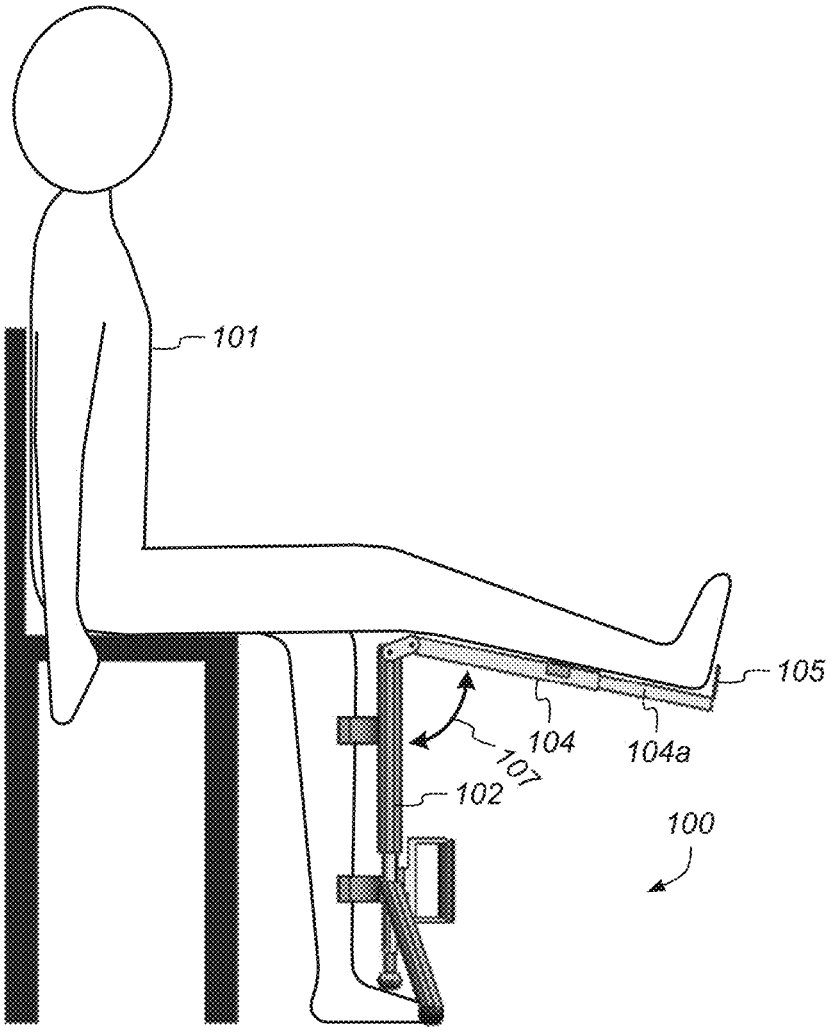
FIG. 24 illustrate one embodiment of a crutch that has members for multiple modes of use with a platform member in a sitting mode including an extension extending out of the platform member in use by a user at a third angle.

In some embodiments, an angle 107 between platform member 104 and base 102 may be adjusted for comfort and/or rehabilitation (e.g., as depicted in FIGS. 22-24). For example, angle 107 may be set such that the angle is obtuse as depicted in FIG. 22. In some embodiments, angle 107 may be set such that the angle is at a substantially right angle (e.g., as depicted in FIG. 23). In some embodiments, angle 107 may be set such that the angle is acute (e.g., as depicted in FIG. 24).

Compact Mode

Figure 10:
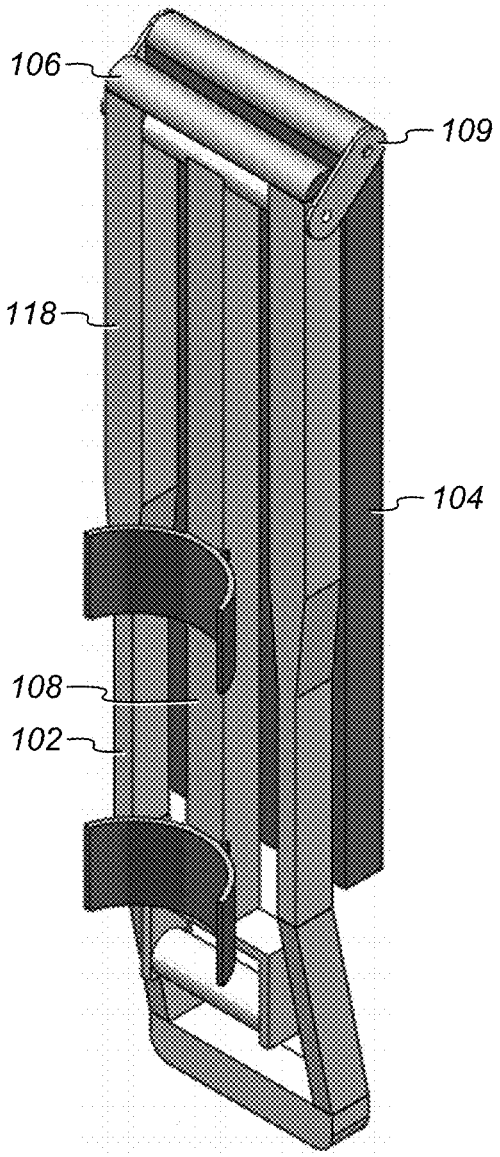
FIG. 10 is a perspective view illustrating one embodiment of a compact mode of a crutch system.
Figure 11:
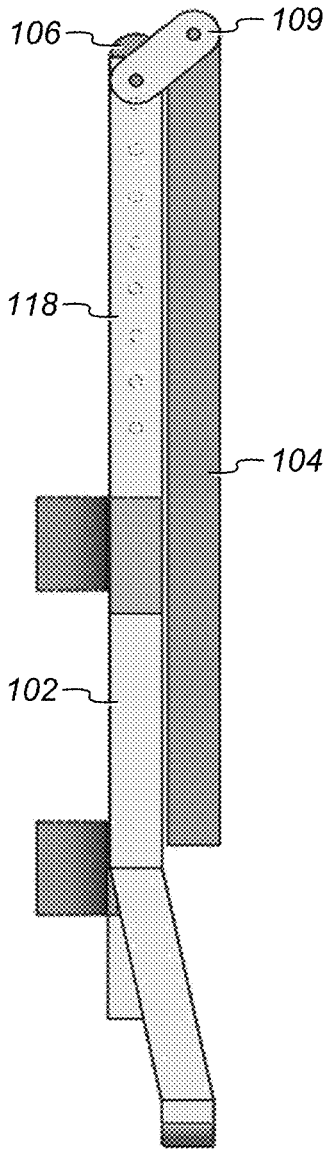
FIG. 11 is a side view illustrating one embodiment of a compact mode of a crutch system.

FIG. 10 is a perspective view illustrating one embodiment of a compact mode of a crutch system. FIG. 11 is a side view illustrating one embodiment of a compact mode of a crutch system. The crutch may be transformed to small, portable and light-weight form. As illustrated in FIGS. 10 and 11, platform 104 and upper leg support member 108 may be folded down on base 102. Upper support 106 may retracted into tubes of base 102.

Figure 27:
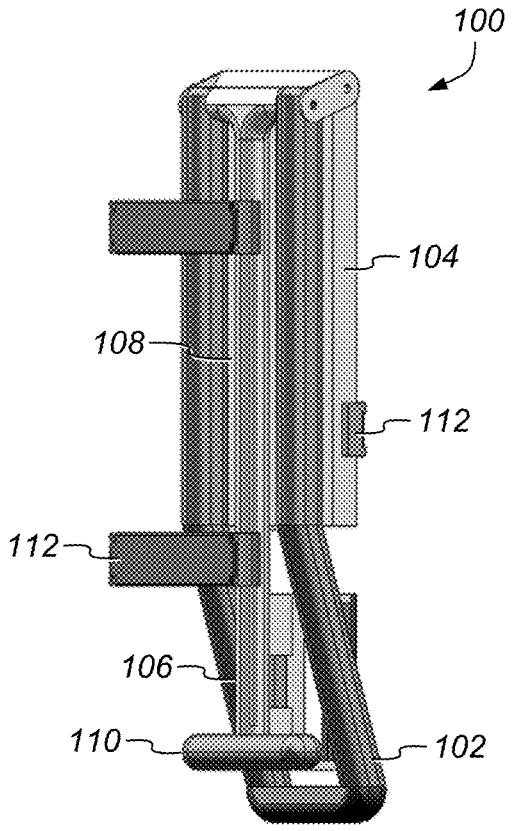
FIG. 27 is a perspective view illustrating one embodiment of a compact mode of a crutch system.

FIG. 27 is a perspective view illustrating one embodiment of a compact mode of a crutch system. The embodiment depicted in FIG. 27 depicts a more efficient design. At least one difference is that upper support 106 is now combined with an upper support leg support member 108 such that there are fewer parts for a user to deal with when converting from different modes of the crutch 100. The compact mode collapses the crutch in a small form in order to use as little space as possible when the crutch is not being actively used.

The compact mode makes it easier to deal with the transportation and lack of space on a vehicle by using a smaller amount of space, making it easy to carry while the injured person commutes or travels anywhere. In some embodiments, the crutch is placed in the compact mode without removing pieces from the device or without using any extra tools. With to 2-3 moves (depending on the original position) the crutch can be folded quickly into the compact mode.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Methods may be implemented manually, in software, in hardware, or a combination thereof. The order of any method may be changed, and various elements may be added, reordered, combined, omitted, modified, etc. Changes may be made in the elements described herein without departing from the spirit and scope of the invention as described in the following claims.

What is claimed is:

1. A crutch, comprising:

a base;

one or more leg support members coupled to the base, wherein at least one of the leg support members is configurable to at least partially bear the weight of a person through the person's leg;

an upper leg coupling member, wherein the upper leg coupling member comprises a hand grip, herein the upper leg coupling member is foldable with respect to the base; and an axillary support member coupled to the base, wherein the axillary support member is configurable to extend under one of the user's arms to at least partially bear weight of the person.

2. The crutch of claim 1, wherein the axillary support member is adjustable to reversibly transform the crutch between axillary support of the person and leg support of the person.

3. The crutch of claim 1, wherein the axillary support member is telescopically adjustable with respect to the base.

4. The crutch of claim 1, wherein at least one of the leg support members comprises a platform, wherein at least a portion of the platform is configurable to extend rearwardly from the base.

5. The crutch of claim 1, wherein at least one of the leg support members comprises a platform, wherein at least a portion of the platform is configurable to extend rearwardly from the base, and wherein a length of the platform is adjustable.

6. The crutch of claim 1, wherein at least one of the leg support members comprises a platform, wherein at least a portion of the platform is configurable to fold with respect to the base.

7. The crutch of claim 1, wherein at least a portion of the axillary support member is positionable in the upper leg coupling member such that the axillary support member extends, during use, from the upper leg coupling member.

8. The crutch of claim 1, wherein the upper leg coupling member comprises one or more straps configured to couple with the upper leg of the person.

9. The crutch of claim 1, wherein the one or more leg support members are configured to at least partially compact with respect to the base.

10. The crutch of claim 1, wherein at least one of the leg support members comprises a platform, wherein at least two of the following are foldable with respect to the base: the axillary support member, the platform, and the upper leg coupling portion.

11. A crutch, comprising:

a base; and one or more leg support members coupled to the base, wherein at least one of the leg support members is configurable to at least partially support a person via a leg of the person, an axillary support member coupled to the base, wherein the axillary support member is configurable to extend under one of the user's arm to at least partially bear weight of the person, wherein at least one of the leg support members comprises an upper leg coupling member coupled to the base, and wherein at least a portion of the axillary support member is positionable in the upper leg coupling member such that the axillary support member extends, during use, from the upper leg coupling member;

wherein at least a portion of the one or more leg support members is configurable to fold with respect to the base.

12. The crutch of claim 11, wherein at least one of the leg support members comprises a knee pad, wherein at least a portion of the knee pad is configurable to have a horizontal surface.

13. The crutch of claim 11, wherein at least one of the leg support members is foldable with respect to the base.

* * * * *